US005453916A

United States Patent [19]

Tennis et al.

[11] Patent Number: 5,453,916

[45] Date of Patent: Sep. 26, 1995

[54] MODULAR SAFETY LIGHT SYSTEM

[76] Inventors: Bonnie S. Tennis; John A. Tennis, both of 4114 State Hwy. 10, St. Johnsville, N.Y. 13452

[21] Appl. No.: 169,619

[22] Filed: Dec. 17, 1993

[51] Int. Cl.[6] ..... E01F 13/00

[52] U.S. Cl. ..... 362/152; 362/249; 362/376; 404/6; 439/505

[58] Field of Search ..... 362/153.1, 152, 362/234, 226, 249, 376; 404/6, 9; 439/502, 505

[56] References Cited

U.S. PATENT DOCUMENTS

| | | | |
|---|---|---|---|
| 3,504,169 | 3/1970 | Freeburger | 362/249 |
| 3,807,699 | 4/1974 | France | 404/6 |
| 4,128,863 | 12/1978 | Premetz | 362/249 |
| 4,714,219 | 12/1987 | Mayse | 362/249 |
| 5,150,964 | 9/1992 | Tsui | 362/249 |

*Primary Examiner*—Ira S. Lazarus
*Assistant Examiner*—Sara Sachie Raab
*Attorney, Agent, or Firm*—Robert O. Wright

[57] ABSTRACT

A modular safety lighting system for highway barriers has a light fixture connected between two sections of flexible fluid tight conduit containing four conductors. A male connector is connected to one end of the conduit and conductors and a female connector is connected to the other end of the conduit and conductors. In a first module the light fixture is connected to a first pair of conductors and in a second module the light fixture is connected to a second pair of the conductors. The modules have a length equal to the length of the barrier on which they are to be mounted and are connected alternately in series to illuminate the highway barrier. Suitable power connection modules are provided to connect the system to a standard utility power pole.

6 Claims, 6 Drawing Sheets

MODULAR SAFETY LIGHT SYSTEM

BACKGROUND OF INVENTION

This invention relates to modular safety lighting systems and more particularly to a safety light module for use on highway barriers used to safely separate and guide vehicular traffic around construction sites, obstructions or other safety hazards.

In todays modern highway systems it is frequently necessary to alert vehicular traffic to potential obstructions when it is dark or visability is limited. This is particularly true at construction sites on high speed super highways. Traditionally red or yellow warning lights have been spaced at intervals around the obstruction to safely direct the traffic through the hazardous area. In recent years many highway departments have used individual battery operated lights placed along the tops of barriers, fencing and the like. These lights have had to be secured against theft, as well as checked regularly for proper operation. Even though electric eye switches are used to turn them on and off batteries must be frequently replaced and maintenance of these lights has been an increasingly expensive and burdensome requirement for highway contractors. The only alternative heretofore has been to hard wire in regular electric lights using surface mounted boxes and metallic conduit in order to meet code requirements. As is well known in the industry rigid metallic conduit has been required to protect electrical wire contained therein from damage that could cause a short circuit or other malfunction in an electrical installation. Flexible, fluid tight conduit, which combines a protective, flexible, metallic shield with a weather tight covering, has been approved as providing equivalent protection to rigid metallic conduit for most applications.

OBJECTS AND SUMMARY OF INVENTION

Accordingly it is an object of the present invention to provide a modular safety lighting system that overcomes the limitations of the prior art.

It is another object of the present invention to provide a safety light module that can be quickly and easily mounted on traffic barriers and the like and connected together with similar modules to a source of electric power to form a safety lighting system.

It is a further object of the present invention to provide a flexible safety light module that can be easily removed and compactly stored for future use.

It is a still further object of the present invention to provide a safety light system with multiple circuits so that failure of one circuit will not disable the entire system.

It is a still further object of the present invention to provide a modular safety light system which allows the safety lights to be pre-installed on modular traffic barriers before placement of the barriers at the job site.

It is a still further object of the present invention to provide a modular safety light system that is weatherproof and includes power connection and power tool receptacle modules.

It is yet another object of the present invention to provide a safety light module having multiple light and or utility units.

It is yet another object of the present invention to provide a modular safety lighting system having male and female end connectors arranged so as to only be connectable into a weatherproof barrier lighting assembly.

In one embodiment of the present invention a safety light module comprises a flexible fluid tight conduit provided with dual power circuits connected at one end to a male connector and at the other end to a female connector with at least one light connected to at least one of the power circuits intermediate the male and female connectors.

BRIEF DESCRIPTION OF THE DRAWINGS

The invention will become better understood from the following description, taken in conjunction with the drawings in which.

DETAILED DESCRIPTION OF A PREFERRED EMBODIMENT

Figure 1:
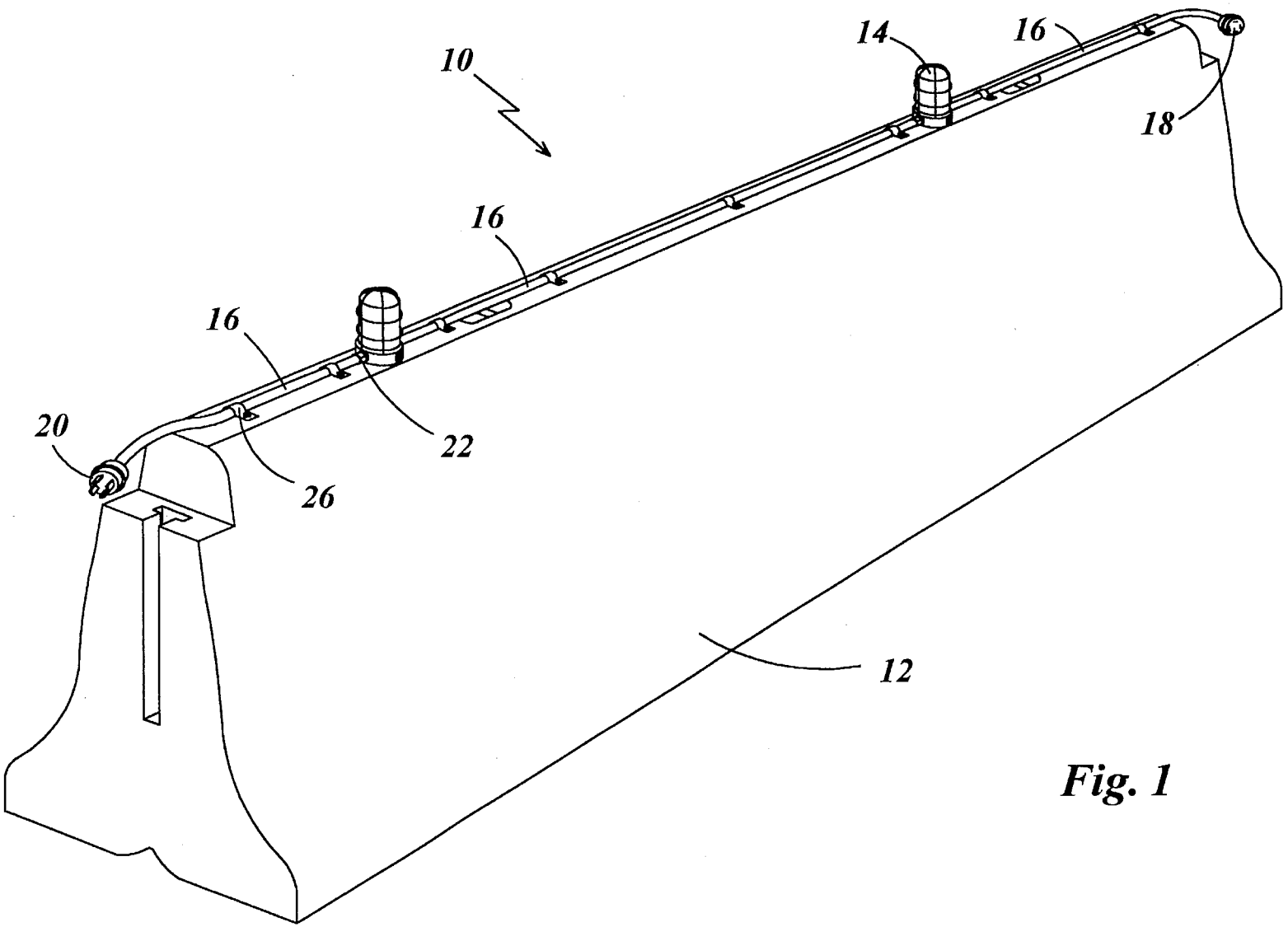
FIG. 1 is a perspective view of an embodiment of the present invention installed on a "Jersey" barrier for highway use.
Figure 2:
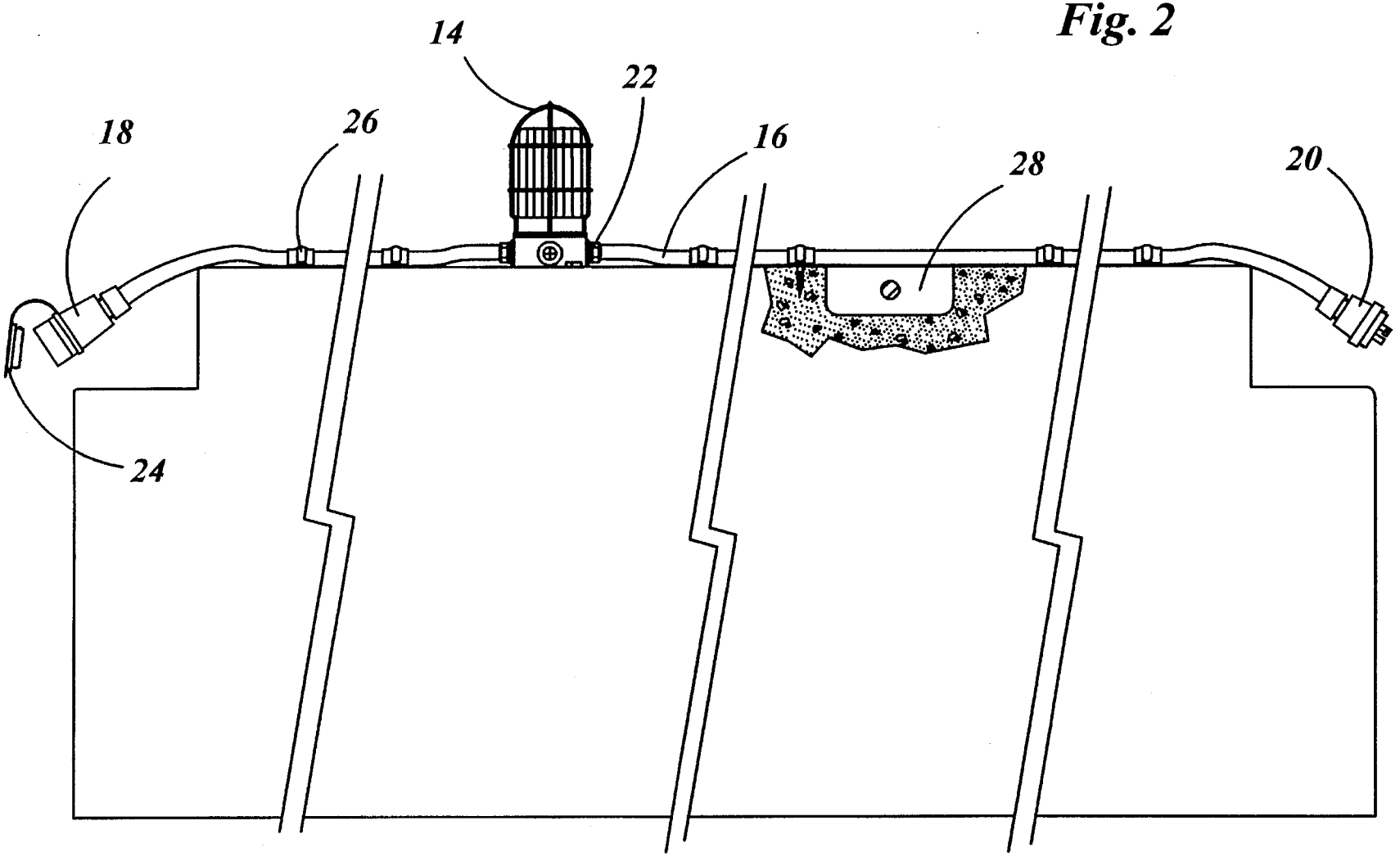
FIG. 2 is a partial side view partially broken away of the embodiment of FIG. 1.

Referring now to FIGS. 1 and 2 there is shown a safety light module 10 according to the present invention mounted on a barrier 12. Barrier 12 has the familiar concave tapered cross section, wider at the base and narrower at the top, typically has an overall length of twenty feet, and is known in the trade as a "Jersey Barrier". The module 10 is mounted on the narrow top of barrier 12 and includes two light fixtures 14 having fixed thereto on opposite sides flexible, fluid tight lengths of conduit 16. A female connector 18 is connected to the end of conduit 16 at the right hand end in FIG. 1 and a male connector 20 is connected to the other end of conduit 16 at the left hand end of FIG. 1. The connectors 18 and 20 are fluid tight and form with conduit 16 a weatherproof joint. Similar fluid tight connectors 22 are used to join conduit 16 to each side of the bases of lights 14. Female connector 18 has a closure flap 24 which in the closed position seals the end against water entry. The result is a weatherproof assembly when interconnected with similar modules. The module 10 is mounted on the barrier 12 by a series of U shaped clips 26 which are power nailed or otherwise secured to the barrier.

The clips 26 are positioned over the flexible conduit 16 at spaced intervals along the lengths of conduit. It has been found that by securing the module to the barrier by clips 26 over the conduit instead of fixing the light fixture to the barrier the light fixtures become somewhat resiliently mounted and resist damage from impact. When mounted this way the light fixtures tend not to shatter and become destroyed but rather come apart, requiring only reassembly after impact with a timber for instance.

Referring now to FIG. 2, the standard "Jersey" barrier module is provided with recessed lifting means 28, spaced approximately five feet from each end. As shown in FIG. 2, a bar is embedded in the cement of the barrier 12 before it is cast. Hooks, eyes or other means can be used instead of the bars shown if desired. The lifting means 28 are spaced equally from the ends of the barrier module so that when the barrier is lifted by a crane for placement it will balance. To ensure that the light module 10 will not interfere with or be damaged by the crane hook and cables etc. used to lift the barrier 12 into place the lights 14 are spaced from the ends of the conduit 16 a distance of three feet from the left end and seven feet from the right end all as shown in FIG. 2. This leaves ten feet between lights per module and when connected with other similar modules 10 all light intervals will also be ten feet. As will be described in more detail herein when only one light is provided in a module it is placed at the center of the module which avoids the lifting means 28 and results in a light interval of twenty feet.

Figure 7:
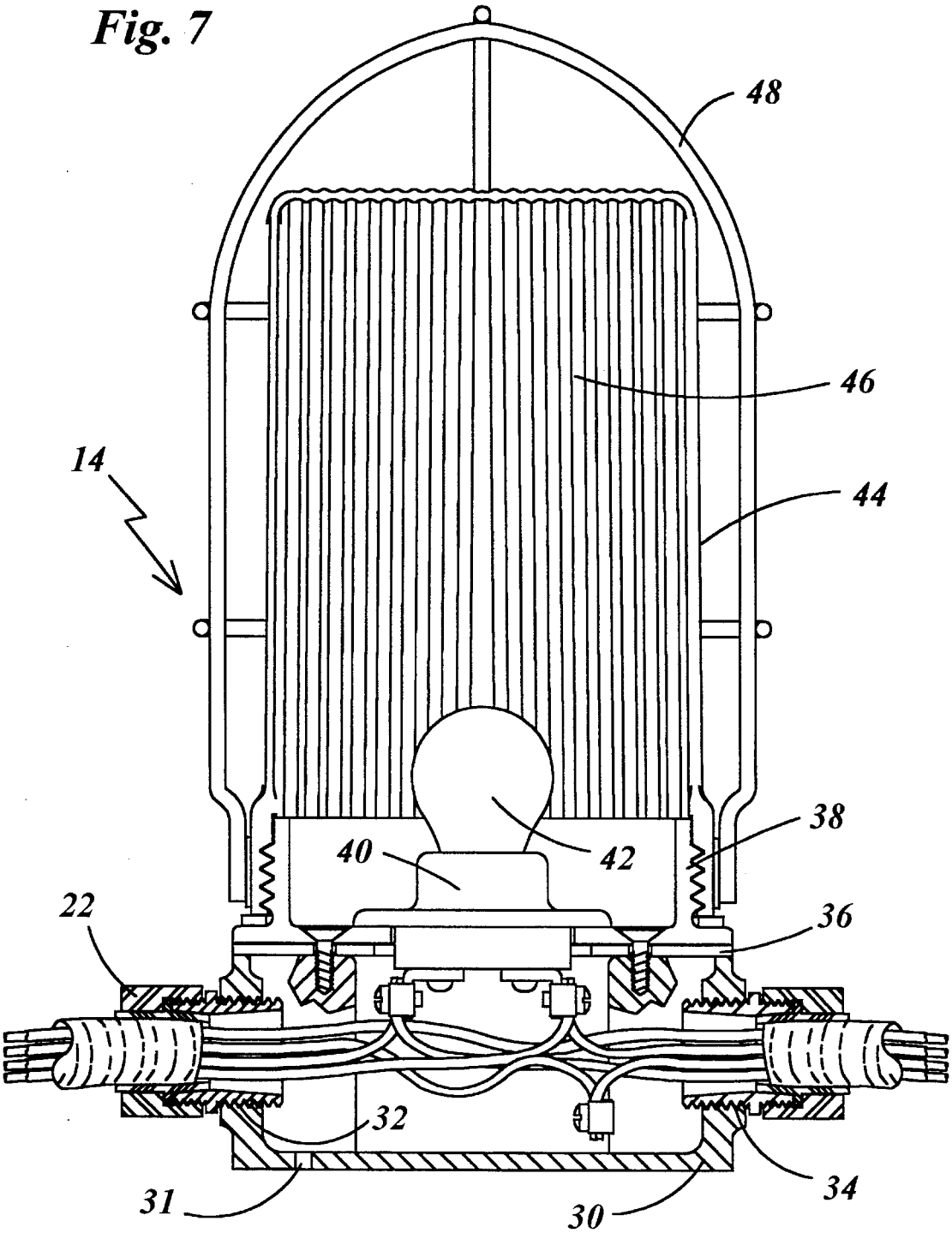
FIG. 7 is a cross sectional view of one of the lights of FIG. 1.

In FIG. 7 there is shown a typical light 14. Light 14 includes a base 30 formed from rigid plastic or metal. The base 30 has inlet and outlet ports 32 and 34 which are usually threaded to receive connectors 22. A cover 36 for base 30 carries thereon a threaded annular flange 38 and has mounted thereon bulb receptical 40 with bulb 42 screwed therein in usual fashion. A lens 44 is mounted over bulb 42 by engagement with threaded flange 38. In a preferred embodiment the lens 44 is a molded polycarbonate cup having a series of ribs 46 which help to extend transmitted light to the top thereof. A protective metal wire cage 48 is secured about the lens 44 on base 30 by a clamp (not shown). Weep holes 31 may also be provided in the bottom of light fixture 30 to allow for release of moisture accumulated within lens 44. Bulb 42 is chosen so that with lens 44 the desired illumination is achieved for the particular application. Typically for highway barrier applications a seven and one half watt bulb with an amber lens provides the required illumination. Other wattages and colors may obviously be used.

Figure 3:
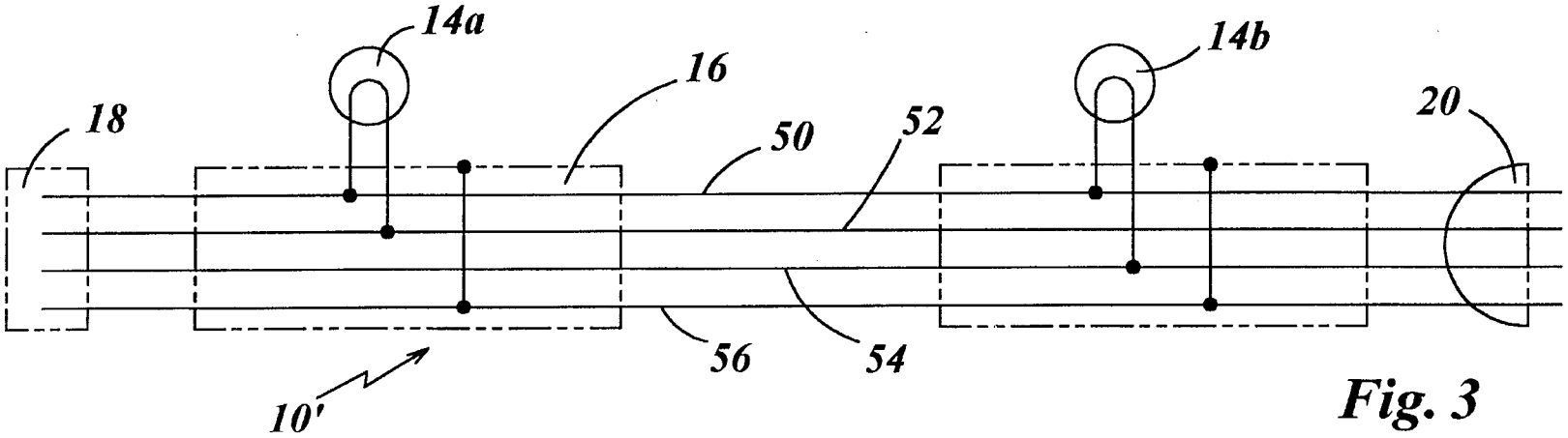
FIG. 3 is a schematic view of the embodiment of FIG. 1.

Referring now to FIG. 3 there is shown the electrical schematic for the light module 10. Each module is provided with four conductors 50,52,54, and 56. The conductors are terminated at one end in female connector 18 and at the other end in male connector 20. Conductor 50 serves as the common power line and conductors 52 and 54 serve as the hot wires of two separate power circuits. Conductor 56 is the ground wire. Conductors 50–56 are color coded white, black, red, and green as is customary. Light 14*a* is connected between conductors 50 and 52. Light 14*b* is connected between conductors 50 and 54. Since conductors 52 and 54 are connected to separate power sources no two adjacent lights 14 will be connected to the same circuit and therefore power failure on one circuit will not completely extinguish the safety barrier lighting. This is an especially important safety feature of the present invention.

Figure 4:
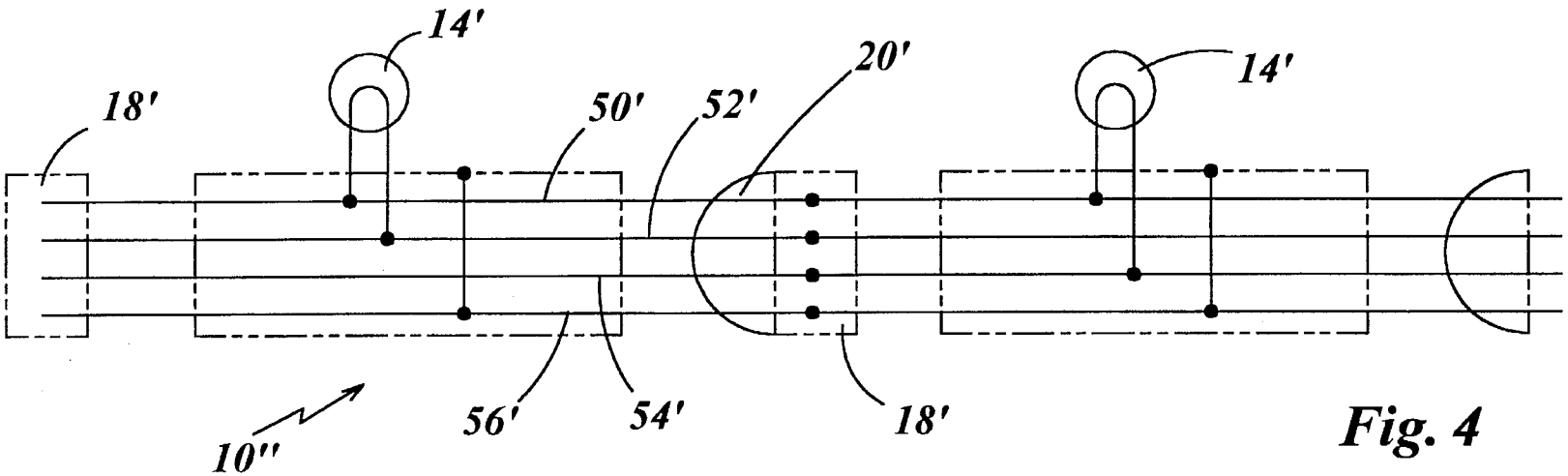
FIG. 4 is a view similar to FIG. 3 of another embodiment of the present invention.

FIG. 4 shows another embodiment of the present invention in which each light module 10' and 10" has only one light 14' connected therein. In module 10' light 14' is connected between conductor 50' and 52'. In module 10" light 14' is connected between conductor 50' and 54'. Thus when light modules 10' and 10" are connected alternately in series along a barrier the same safety feature is provided, namely upon failure of one of the two power circuits feeding the barrier lighting system, only every other light will be extinguished. To facilitate proper connection the light modules 10' and 10" may be color coded or otherwise identified so that the field crews may readily identify them and connect them in the proper sequence.

Figure 6:
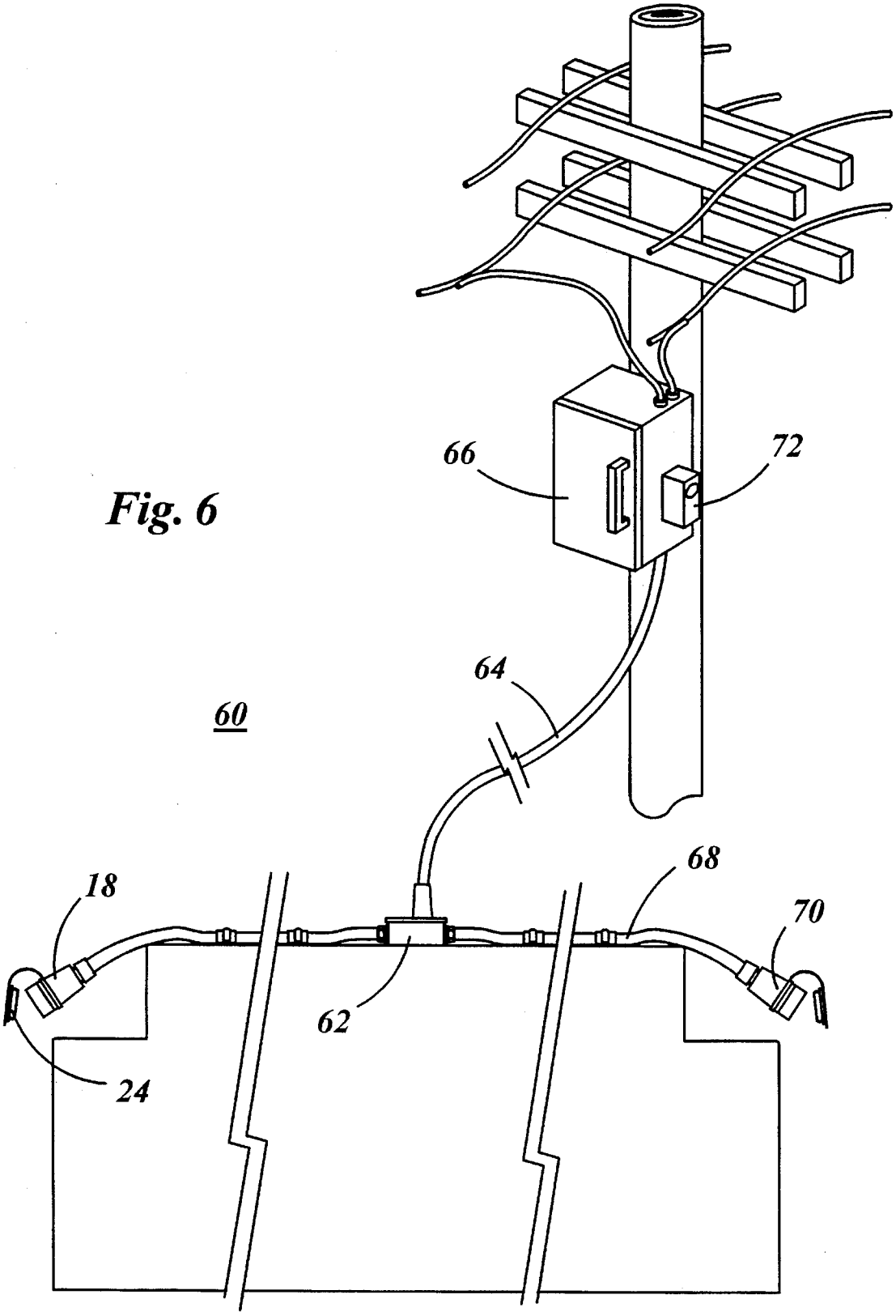
FIG. 6 is a diagramatic view of a power connection box module according to the present invention connected to a power pole.

FIG. 6 shows a power line connection module 60 according to the present invention. Module 60 includes a junction box 62 to which is connected the power pigtail 64 which is adapted to be connected to a conventional roadside power company pole through relay 66. Also connected to box 62 are one or more light module pigtails 68 which comprise a short length of conduit with a female connector 70 on the distal end. Pigtails 64 and 68 carry the same four conductors as shown in FIGS. 3 and 4 and through relay 66 are connected to two separate power circuits. A photo cell 72 is connected to relay 66 to turn the power on and off in accordance with ambient light conditions.

It should be noted that by providing the power module with only female connectors the safety lighting system will always end up, when connected together, with a weatherproof assembly because the unconnected end will be a female fluid tight closure. Module 60 may be of any convenient length and in one embodiment having two pigtails the overall length is three feet.

Figure 5:
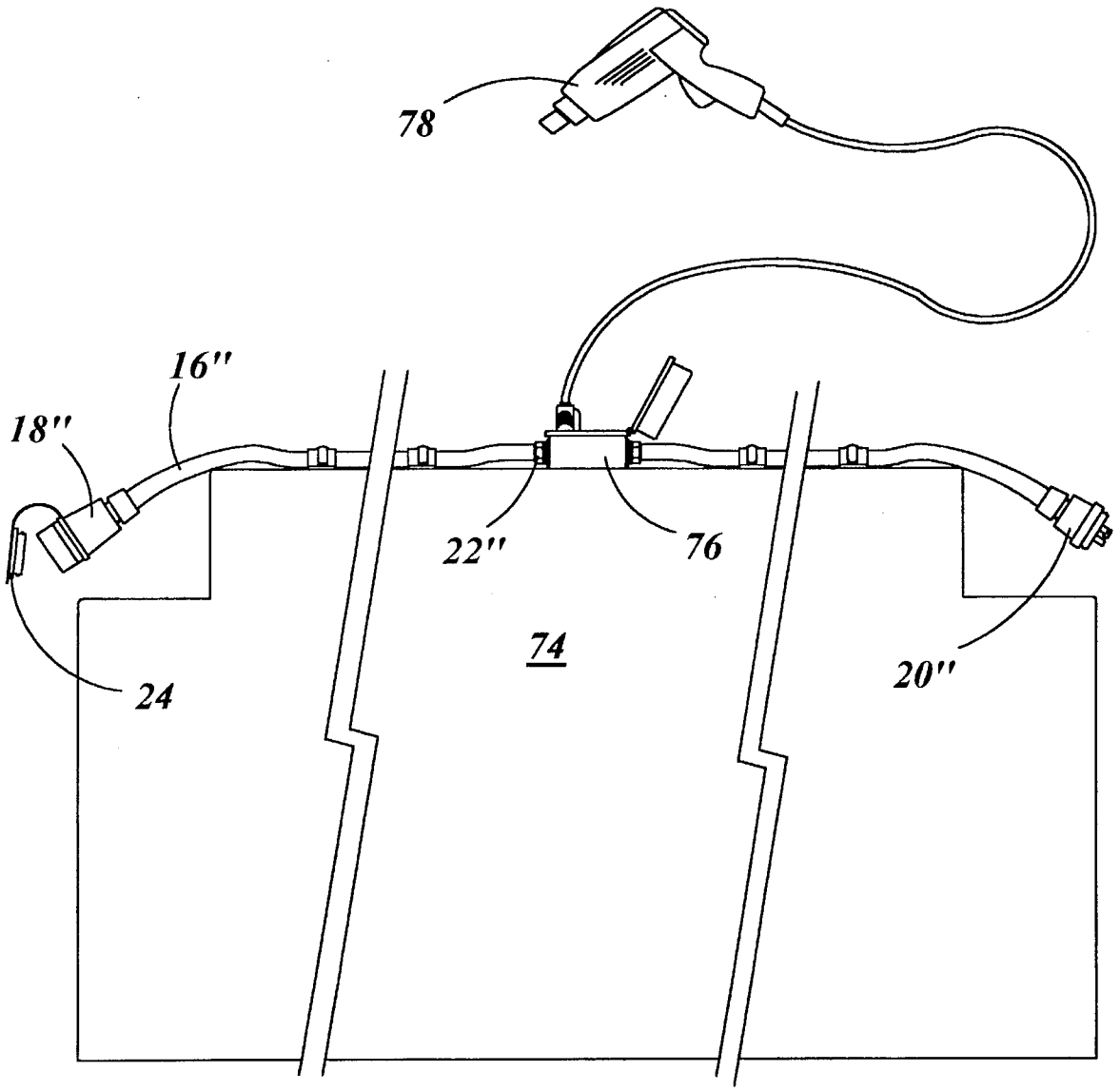
FIG. 5 is a side view similar to FIG. 2 showing another embodiment of the invention.

FIG. 5 shows another embodiment of the present invention in which a power receptacle module 74 is provided in place of or in addition to a light module 10. Power receptacle module 74 includes an outlet box 76 with a weatherproof cover and at least one female plug. Box 76 is connected to a conduit 16" on either end. Conduit sections 16" are connected at the distal ends to connectors 18" and 20". Again four wires are provided within conduit 16" and connected to the connectors 18" and 20" so that two separate power circuits are formed. The plugs of outlet box 76 may be connected one to each circuit or both to one circuit as desired. Electric tools such as drill 78 may then be plugged into box 76 and used on the job without the need of a separate generator. (not shown)

In use the various modules of the present invention may be quickly and easily connected together in a desired sequence on the job site to provide a safety light system for a traffic barrier, boat waterway, building hazard and the like. Alternatively the individual modules may be pre-mounted on each barrier section before installation of the barriers at the job site. Either way the use of the modules of the present invention greatly facilitates the creation and installation of safety lighting systems.

While this invention has been explained with reference to the structures disclosed herein, it is not confined to the details as set forth and this application is intended to cover any modifications and changes as may come within the scope of the following claims.

What is claimed is:

1. A highway traffic barrier member comprising:

a "Jersey barrier" formed of concrete having a narrow top and concave sides extending down to a wide base;

a light module mounted on the narrow top of said "Jersey barrier";

said light module comprising at least one light fixture mounted on a flexible conduit containing a plurality of conductors and having a male connector at one end and a female connector at the other end;

said light module having a length equal to the length of said "Jersey barrier" so that when a number of traffic barrier members are placed end to end the light modules may be electrically connected in series to provide safety lights along said highway barrier members.

2. A highway traffic barrier according to claim 1 wherein said light module includes two light fixtures mounted spaced apart along said flexible conduit.

3. A highway traffic barrier according to claim 2 wherein one of said two light fixtures is mounted three feet from one end of said conduit and the other light fixture is mounted seven feet from the other end of said conduit.

4. A module for use in safety lighting systems on safety barriers and the like having a predetermined length which comprises:

a length of fluid tight flexible conduit having first and second ends;

at least one electrical fixture mounted in fluid tight relationship on said conduit;

a plurality of electrical conductors positioned within said conduit;

at least two of said conductors being electrically connected to said electrical fixture;

a first electrical termination device mounted in fluid tight relationship on said first end of said conduit connected to said plurality of electrical conductors;

a second electrical termination device mounted in fluid tight relationship on said second end of said conduit connected to said plurality of electrical conductors;

said length of fluid tight flexible conduit, electrical fixture, and electrical termination devices when assembled together having a length equal to the length of a safety barrier on which the module is to be mounted.

5. A module as described in claim 4 wherein said electrical fixture is an electrical outlet box and plug.

6. The method of installing lighting systems along outdoor structures which comprises:

forming a plurality of light modules each having a standard predetermined length of flexible conduit carrying a plurality of electrical conductors therein;

mounting a light fixture on said conduit;

connecting said light fixture to one pair of conductors in said conduit;

connecting male and female plugs respectively at the ends of said conduit;

choosing the length Of said light modules to equal the length of a highway traffic barrier on which the modules are to be installed;

mounting a module on a highway traffic barrier with a plurality of clips extending over and spaced along said predetermined length of flexible conduit before installing the barrier along an outdoor structure;

installing a series of barriers having fixed thereon a light module along an outdoor structure to form a traffic barrier;

connecting said male and female plugs on the ends of said light modules to the plugs of the adjacent light modules fixed on the adjacent traffic barriers; and connecting a power source to one end of said interconnected plurality of modules.

* * * * *